United States Patent [19]

Schmidt

[11] Patent Number: 4,779,997

[45] Date of Patent: Oct. 25, 1988

[54] CLOSURE FOR A PORT AND CLOSURE ASSEMBLY

[75] Inventor: Josef Schmidt, Libertyville, Ill.

[73] Assignee: Baxter Travenol Laboratories, Inc., Deerfield, Ill.

[21] Appl. No.: 42,767

[22] Filed: Apr. 27, 1987

[51] Int. Cl.[4] ..... B65D 33/18

[52] U.S. Cl. ..... 383/96; 220/DIG. 19; 215/317

[58] Field of Search ..... 383/96; 138/89, 96 R; 220/DIG. 19; 215/317, 320

[56] References Cited

U.S. PATENT DOCUMENTS

| | | | |
|---|---|---|---|
| D. 185,724 | 7/1959 | Terwilliger . | |
| 1,747,760 | 2/1930 | Duffy et al. . | |
| 2,168,239 | 8/1939 | Reach . | |
| 2,485,996 | 10/1949 | Atkin . | |
| 2,595,877 | 5/1952 | Otano | 383/96 |
| 2,669,369 | 2/1954 | Towns . | |
| 2,814,404 | 11/1957 | Towns . | |
| 3,030,955 | 4/1962 | Gossett et al. . | |
| 3,073,472 | 1/1963 | Williams . | |
| 3,223,269 | 12/1965 | Williams . | |
| 3,411,652 | 11/1968 | Shuffrey et al. . | |
| 3,459,320 | 8/1969 | Itoh . | |
| 3,905,368 | 9/1975 | Lewis et al. | 128/222 |
| 3,987,930 | 10/1976 | Fuson | 138/96 R |
| 3,994,412 | 11/1976 | Difiglio | 220/266 |
| 4,008,820 | 2/1977 | Ruetz | 215/256 |
| 4,046,276 | 9/1977 | Winchell et al. | 215/250 |
| 4,482,070 | 11/1984 | Dubach | 215/250 |

FOREIGN PATENT DOCUMENTS

| | | | |
|---|---|---|---|
| 230659 | 9/1960 | Australia | 215/320 |
| 1094364 | 12/1967 | United Kingdom | 383/96 |

*Primary Examiner*—Willis Little

*Attorney, Agent, or Firm*—Paul C. Flattery; Robert M. Barrett; Mary R. Jankousky

[57] ABSTRACT

A closure for removably sealing a port is provided. The closure includes a guide member receivable within an opening of a port and a sleeve member extending for a length of the guide member and defining with the guide member an annular channel, at least a portion of the port being received within the annular channel when the closure seals the port, the inner circumference of the sleeve member being sufficiently small to exert a retaining force around the portion of the port so received securing the closure onto the port. The closure includes a handle member having a reduced thickness portion, upon the application of a pulling force on the handle member the reduced thickness portion will stretch before the retaining force exerted by the closure on the port is overcome.

12 Claims, 1 Drawing Sheet

CLOSURE FOR A PORT AND CLOSURE ASSEMBLY

The present invention relates generally to port and closures for containers. More specifically, the present invention relates to an improved closure.

In certain packaging arts, it is desirable to provide the user with a port through which he may access the contents of a package. For example, in the medical field, ports function as a means for allowing one to access the contents within the container so that they can be infused into a patient, compound into a second package, or mixed with additional components. To this end, the ports provide a means for receiving a spike or other piercing means. An example of such a container with a port is the VIAFLEX® container, manufactured by Travenol Laboratories of Deerfield, Ill., U.S.A.

Especially in the medical field, it is necessary to maintain a portion of the port, specifically the area of the port that receives the spike or piercing means, in a sterile condition. Failure to maintain this internal portion of the port in a sterile condition can result in contamination of the contents of the container that could prove hazardous if the contents are infused into a patient. Accordingly, ports typically include a closure member that is designed to removably seal the port until the port is to be utilized.

Typically, the closure member includes a handle member, a sleeve member, and a guide member. The guide member is received within an internal channel defined by the port and the sleeve member circumscribes at least a portion of the exterior of the port when the closure seals the port. A handle member is provided to allow the user to remove the closure from the port. To this end, the handle member is gripped by the user and pulled causing the closure to be removed from the port so that the port can be accessed.

Some prior art port and closure assemblies do not function entirely satisfactorily. For example, some prior art closure assemblies do not provide a sufficiently good gripping surface on the handle to allow one to remove the closure. This is especially true when the closure or the fingers of the user are wet. Moreover, some prior closure assemblies have a construction such that during the removal process of the closure from the port, the user's fingers can accidently contaminate the port area. Likewise, some closure assemblies have a construction that is not conducive to mass production, and therefore, is not practical for commercial applications. Furthermore, some handle members, because they are constructed from a rigid material, do not sufficiently bend or give on impact and accordingly, if impacted, the closure can assume a distorted position on the port. This can result in the closure being difficult to remove from the port or not maintaining a sterile closure assembly.

Accordingly, there is a need for an improved closure for a port and closure assembly.

The present invention provides a closure for removably sealing a port. The closure comprises a guide member, sleeve, and handle. The guide member is receivable within an opening of the port, and extends from a first end of the closure. The sleeve member extends for a length of the guide member and defines with the guide member an annular channel. At least a portion of the port is received within the annular channel when the closure seals the port. The inner circumference of the sleeve member is sufficiently small so that it exerts a retaining force around the portion of the port so received securing the closure onto the port. The handle member extends from a second end of the closure. The handle member has a gripping surface that defines a reduced thickness portion. Upon the application of a pulling force on the handle member, the reduced thickness portion will stretch before the retaining force exerted by the sleeve on the portion of the port is overcome.

Preferably, the handle includes a top portion having an increased thickness.

Preferably, the reduced thickness portion of the handle is defined by two concave portions located on opposite sides of the handle.

Preferably, the closure is constructed from EPDM rubber.

Preferably, the closure will not be pulled out of the port, i.e. the retaining force exerted will not be overcome, until a pulling force of 10 pounds is exerted on the closure.

Accordingly, an advantage of the present invention is to provide an improved closure for a port and closure assembly.

A further advantage of the present invention is to provide an improved port and closure assembly for flexible medical containers.

A still further advantage of the present invention is to provide a closure that has a handle that provides a good gripping surface under wet or dry conditions.

Moreover, an advantage of the present invention is to provide a closure that can be molded in simple multicavity molds.

Still another advantage of the present invention is to provide a closure that minimizes touch contamination of the sterile portions of the port during removal of the closure.

Another advantage of the present invention is to provide a closure having a handle that will bend on impact lessening possible distortion positioning of the closure on the port.

Furthermore, an advantage of the present invention is to provide a handle that is contoured to provide more gripping area.

Another advantage of the present invention is to provide a closure having a handle that affords a snap action.

Additional features and advantages are described in, and will be apparent from, the detailed description of the presently preferred embodiments and from the drawings.

The present invention provides an improved closure for sealing a port. Ports are utilized to provide means of accessing the contents of a container with a spike or other piercing means. For example, in the medical industry, ports are utilized as a means for providing a channel through which a needle or spike is received to allow one to access the contents of the container. In order to maintain the interior areas of the port, and specifically, the channel for receiving the spike or piercing means, in a sterile condition, closures are utilized to removably seal the ports prior to the container being accessed. Accordingly, the closures provide a removable means for maintaining the sterility of interior portions of the port. As used herein, the term "port" means any means for providing a channel or path to access a container; and the term "closure" means any means for removably sealing the port so that the sterility of the internal channel portion of the port is maintained.

Figure 1:
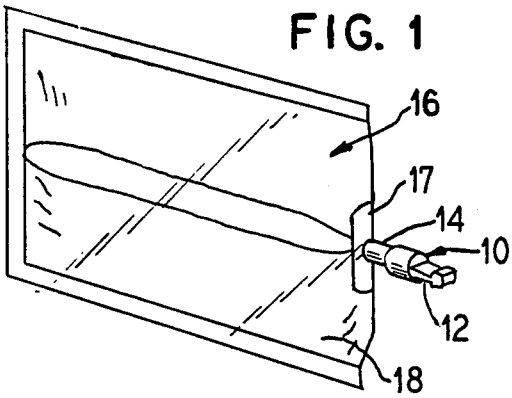
FIG. 1 illustrates a side elevational view of a flexible container to which is secured the port and closure assembly of the present invention.

Referring now to FIG. 1, a port and closure assembly 10 of the present invention is illustrated. The port and closure assembly 10 includes a closure 12 which removably seals the port 14. The port 14 includes an elongated neck member 15 and a base 17. The base 17 is secured to a web of film that defines the container 16. The container 16 is constructed so that it can house a product 18 that is to be removed or accessed via the port 14. Although the container 16 illustrated is a flexible container such as the VIAFLEX® container manufactured by Travenol Laboratories of Deerfield, Ill., it should be noted that the closure assembly can be utilized with a rigid or semi-rigid container. As discussed in more detail below, the closure 1 functions to removably seal internal portions of the port 14 so that they do not become contaminated. Specifically, the closure 12 seals a channel 26 of the port 14.

Figure 3:
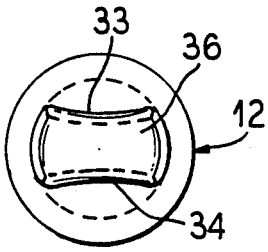
FIG. 3 illustrates a top elevational view of the closure of FIG. 2.
Figure 2:
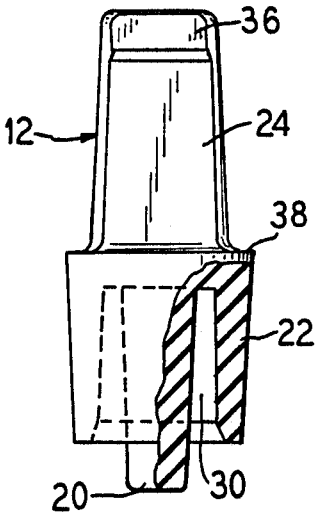
FIG. 2 illustrates a top elevational view, with parts broken away, of an embodiment of the closure of the present invention.
Figure 4:
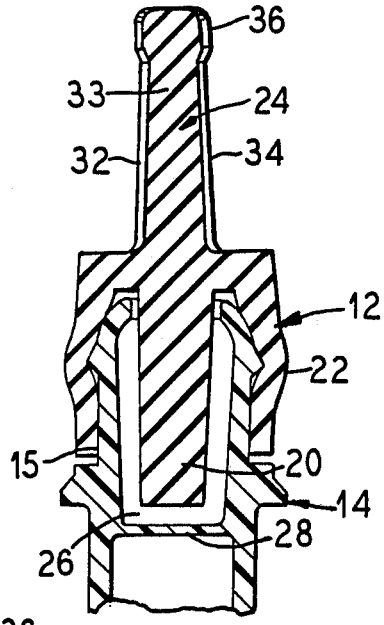
FIG. 4 illustrates a cross-sectional view of the closure of the present invention sealing a port.

Referring now to FIGS. 2–4, the closure 12 of the present invention is illustrated. The closure 12 includes a guide member 20, sleeve member 22, and handle 24. The guide member 20 is designed to be received within a channel 26 of the port 14. The channel 26 functions as a spiking orifice to allow a needle or spike to be received within the port 14 so that it can pierce the membrane 28 and establish fluid communication between a channel in the spike and the internal portions of the container 16.

As illustrated, the sleeve member 22 extends for a portion of the length of the guide member 20. The sleeve member 22 cooperates with the guide member 20 to define an annular channel 30 that receives a portion of the neck 15 of the port 14. Accordingly, the sleeve member 22, when the guide member 20 is received within the channel 26 of the port 14, extends around at least a portion of the length of the neck 15. The annular channel 30 defined by the sleeve member 22 and guide member 20, has a sufficiently small inner circumference so that a secure fit is created between the closure 12 and the port 14 when the guide member 20 of the closure 12 is received within the channel 26 of the port 14. This secure fit insures that the closure 12 will be secured to the port 14 until the user removes the closure 12 to access the port 14. Accordingly, the sleeve member 22 functions to exert a retaining force on the port 14.

In order to remove the closure 12 from the port 14, a handle 24 is provided. The handle 24 includes gripping surfaces 32 and 34, a top member 36, and a base member 38. The gripping surfaces 32 and 34 define slightly concave portions of the handle on opposite sides of the handle. These concave portions 32 and 34 define sufficiently long areas to allow one's fingers to securely grip the handle 24. The top member 36 has a sufficiently large thickness to prevent the user's fingers from slipping off the handle 24 as the user attempts to remove the closure 12 from the port 14. In order to remove the closure 12 from the port 14, a pulling force sufficiently large to overcome the retaining force of the sleeve member 22 must be exerted. Preferably, a pulling force of at least ten (10) pounds must be exerted to overcome the retaining force and remove the closure 12 from the port 14.

The gripping surfaces 32 and 34 also function to reduce the cross-sectional width of the handle 24 at the area of the gripping surface 32 and 34. The cross-sectional width of the handle 24 at this area 33 is reduced sufficiently so such that when a sufficient pulling force is exerted on the handle 24, perpendicular to the base 38 of the handle, the handle will stretch a predeterminable distance before the force securing the closure 12 to the port 14 is overcome.

Figure 5:
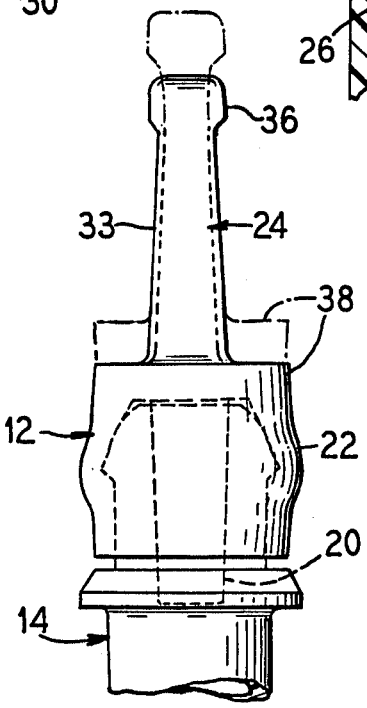
FIG. 5 illustrates the stretch action of the handle of the closure in response to a pulling force on the handle.

Referring to FIG. 5, the stretching action of the handle 24 of the closure 12 is illustrated. As illustrated, the handle 24 will stretch for a portion of its length before the force holding the closure 12 onto the port 14 is overcome. The solid lines of FIG. 5 illustrate the closure 12 in a stretched condition. As the handle 24 is stretched, energy is stored in the stretched portion, creating a stretched rubber band effect. When the force applied to the handle 24 overcomes the retaining force securing the closure 12 to the port 14, the closure will separate from the port in a snap-like action; partly due to the "rubber band effect" of the handle 24. The phantom lines indicate the closure 12 popping out of the port 14 after a sufficient pulling force has been exerted on the closure. This snap action minimizes any chance that the user's fingers will contaminate the sterile sections of the port 14 as the closure 12 is removed.

The closure 12 is constructed from an elastomeric material. Preferably, the closure 12 is constructed from an EPDM rubber. It has been found that an EPDM rubber available from West Company of Pennsylvania functions satisfactorily. As stated above, preferably, a force of 10 pounds is needed to remove the closure 12 from the port 14. Therefore, preferably, the gripping areas 32 and 34 of the handle 24 are constructed so that the area 33 of the handle will stretch until a pulling force of 10 pounds is exerted on the closure 12 and then the closure will be removed from the port 14.

The improved closure 12 of the present invention also provides additional advantages and features. Due to the resilient construction of the handle 24, upon impact the handle 24 will bend lessening the possibility of distorting the position of the closure 12 on the port 14. Moreover, due to its construction, the closure 12 of the present invention can be easily molded on typical single multi-cavity molds.

It should be understood that various changes and modifications to the preferred embodiments described herein will be apparent to those skilled in the art. Such changes and modifications can be made without departing from the spirit and scope of the present invention and without diminishing its attendant advantages. It is therefore intended that such changes and modifications be covered by the appended claims.

I claim:

1. A closure for removably sealing a port comprising:

a solid guide member receivable within an opening of a port, the guide member extending from a first end of the closure;

a sleeve member extending for a length of the guide member and defining with the guide member an annular channel, at least a portion of the port being received within the annular channel when the closure seals the port, the inner circumference of the sleeve member being sufficiently small to exert a retaining force around the portion of the port so received, removably securing the closure to the port; and a solid handle member extending from a second end of the closure, the handle member having a top portion and a reduced thickness portion, at least one of a cross-sectional dimension of the top portion being greater than a similar cross-sectional dimension of the reduced thickness portion, and upon the application of a pulling force on the handle member the reduced thickness portion stretches before the retaining force exerted by the closure on the port is overcome.

2. The closure of claim 1 wherein the reduced thickness portion of the handle is defined by two concave portions located on opposite sides of the handle.

3. The closure of claim 1 wherein the closure is constructed from EPDM rubber.

4. The closure of claim 1 wherein the pulling force required to overcome the retaining force is at least 10 pounds.

5. A port and closure assembly comprising:

a port having a base and an elongated neck portion extending from the base, the neck portion terminating in an opening and defining an inner channel; and a closure for removably sealing the port, the closure including a solid guide member extending from a first end of a base, a solid handle extending from a second end of the base, and a sleeve circumscribing at least a portion of the guide member, the guide member being received within the channel of the port when the closure seals the port, and cooperating with the sleeve to define an annular channel, at least a portion of the neck of the port is received within the annular channel when the closure seals the port, the inner circumference of the sleeve being sufficiently small to exert a retaining force on the portion of the port received in the channel when the closure seals the port, the retaining force removably securing the closure to the port, and the handle including a top portion and a gripping surface of reduced thickness for gripping and pulling the closure, the top portion and base having a greater thickness than the gripping surface, and the gripping surface having a sufficiently reduced thickness to cause the gripping surface to stretch in response to an initial pulling force and a sufficiently large thickness to allow the closure to be removed from the port upon the continued application of the pulling force.

6. The port and closure of claim 5 wherein the gripping surface includes two concave surfaces located on opposite sides of the handle.

7. The port and closure of claim 5 wherein the pulling force required to overcome the retaining force exerted by the sleeve is at least 10 pounds.

8. The port and closure of claim 5 wherein the closure is constructed from an EPDM rubber.

9. A flexible container having a port and closure assembly comprising:

a port having a base and an elongated neck portion extending from the base, the neck portion terminating in an opening and defining an inner channel having an inner piercable membrane defining an upper channel and lower channel, the base being sealed to the flexible container; and a closure for removably sealing the port, the closure including a solid guide member extending from a first end, a solid handle extending from a second end, and a sleeve circumscribing at least a portion of the guide member, the guide member being received within the upper channel of the port when the closure seals the port, and cooperating with the sleeve to define an annular channel, at least a portion of the neck of the port is received within the annular channel when the closure seals the port, the inner circumference of the sleeve being sufficiently small to exert a retaining force on the portion of the port received in the channel when the closure seals the port, the retaining force removably securing the closure to the port, and the handle including a top portion and gripping surface of reduced thickness for gripping and pulling the closure, the gripping surface having a smaller thickness than the top portion and a sufficiently reduced thickness to cause the handle to stretch in response to an initial pulling force and a sufficiently large thickness to allow the closure to be removed from the port upon the continued application of the pulling force.

10. The flexible container of claim 9 wherein the gripping surface includes two concave surfaces located on opposite sides of the handle.

11. The flexible container of claim 9 wherein the pulling force required to overcome the retaining force exerted by the sleeve is at least 8 pounds.

12. The flexible container of claim 9 wherein the closure is constructed from an EPDM rubber.

* * * * *